US007611444B1

(12) United States Patent
Sudeith

(10) Patent No.: US 7,611,444 B1
(45) **Date of Patent: *Nov. 3, 2009**

(54) CLIMBING WALL ASSEMBLY

(75) Inventor: Timothy S. Sudeith, Edina, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 262 days.

This patent is subject to a terminal disclaimer.

(21) Appl. No.: 11/391,785

(22) Filed: Mar. 28, 2006

Related U.S. Application Data

(63) Continuation of application No. 10/236,728, filed on Sep. 6, 2002, now Pat. No. 7,056,266.

(60) Provisional application No. 60/317,726, filed on Sep. 6, 2001.

(51) Int. Cl.
*A63B 9/00* (2006.01)

(52) U.S. Cl. ..... 482/37

(58) Field of Classification Search ..... 482/35–37
See application file for complete search history.

(56) References Cited

U.S. PATENT DOCUMENTS 3,173,386 A * 3/1965 Magers ..... 108/108
4,750,700 A * 6/1988 Wade ..... 248/220.43
5,254,058 A * 10/1993 Savigny ..... 482/37
5,490,650 A * 2/1996 Pendergrass ..... 248/220.31
5,626,478 A * 5/1997 Gatlin ..... 434/247
5,732,954 A * 3/1998 Strickler et al. ..... 273/441
5,762,211 A * 6/1998 Ensign ..... 211/70.6
5,774,919 A * 7/1998 Rich ..... 7/167
5,944,634 A * 8/1999 Neves ..... 482/37
6,003,685 A * 12/1999 Malin ..... 211/7
6,074,327 A * 6/2000 Franklin ..... 482/37
6,231,482 B1 * 5/2001 Thompson ..... 482/37
6,709,365 B2 * 3/2004 Zeilinger ..... 482/35
7,056,266 B2 * 6/2006 Sudeith ..... 482/37

* cited by examiner

*Primary Examiner*—Fenn C Mathew
(74) *Attorney, Agent, or Firm*—Anthony G. Eggink; Katrina M. Egglink

(57) ABSTRACT

A climbing wall assembly for educational and recreational purposes. The climbing wall assembly has a plurality of adjacent wall panels, each having an exterior surface adapted for educational purposes and having a plurality of apertures for mounting hand hold structures. A plurality of climbing paths are thereby available for the assembly. Markable metallic and magnetic wall panel surfaces are further provided whereby climbing paths may be marked and removable magnetic and metallic educational elements may be utilized by the climbers.

17 Claims, 10 Drawing Sheets

CLIMBING WALL ASSEMBLY

This application is a Continuation of U.S. patent application Ser. No. 10/236,728, now U.S. Pat. No. 7,056,266 issued on Jun. 6, 2006, filed on Sep. 6, 2002 and claims the benefit of Provisional Patent Application 60/317,726, filed on Sep. 6, 2001.

BACKGROUND OF THE INVENTION

The present invention relates generally to climbing wall assemblies and particularly to climbing wall assemblies that are utilized for educational and recreational purposes. More particularly, this invention relates to climbing wall assemblies comprised of wall panels having exterior surfaces adapted for use with removable educational elements.

The rock climbing and bouldering sports are becoming increasingly popular activities. As a result, artificial climbing and bouldering walls are increasingly being used for training purposes by climbers. The climbing wall assemblies of the present invention are provided to introduce children into the climbing sports in a safe and educational manner.

The climbing wall assemblies of the invention are constructed and arranged for educational climbing wall activities. The climbing wall assemblies are comprised of versatile, cooperating elements which provide the ability to create a plurality of climbing routes to be used by climbers. The elements may be easily changed and adjusted to provide a variety of educational climbing activities. The climbing wall assemblies of the invention are economical to manufacture, easy to install and are versatile in use.

The climbing wall assemblies of the invention are comprised of wall panels and wall plates and hand holds that are mounted to the wall panels. The wall panels are constructed and arranged to be mounted to a load bearing structure such as a wall of a building or a free standing structure, for example. The climbing wall assemblies may include adjoining writing board wall panels having smooth surfaces, i.e., a "chalkboard" or a "white board", including those having metallic and magnetic properties for receiving erasable markings. Alternatively, the climbing wall assemblies may include adjoining molded wall panels having metallic surface properties for use with magnetic, educational elements. The climbing wall assembly may also incorporate the use of wall plates and hand holds which preferably are molded of a plastic composition and which may incorporate metallic particles for use with magnetic educational elements. The wall panels, wall plates and hand holds are all constructed and arranged to provide a versatile and adjustable climbing wall assembly that permits a plurality of climbing routes to be created and which allows markings to be made on the wall panels and magnetic or metallic pieces to be easily placed and moved by climbers for recreational and educational purposes.

Although the prior art teaches the use of wall structures and hand holds that are used for climbing purposes and other prior art discloses the use of magnetic elements with respect to hand holds, these prior art devices are restricted and limited in use and do not disclose or suggest the climbing wall assembly and components of the present invention. The combination of the molded wall panels, hold or wall plates and hand and foot hold structures having markable and erasable surfaces and/or surfaces with metallic or magnetic properties for use with magnetic or metallic elements are not disclosed in the prior art. A need exists in the wall climbing art for such climbing wall assemblies.

The object of the present invention is to provide a climbing wall assembly that is versatile and permits numerous climbing routes to be created and utilized for educational purposes.

SUMMARY OF THE INVENTION

The magnetic climbing wall assembly of the invention comprises a plurality of wall panels, wall plates, hand holds and educational elements that permit numerous climbing routes to be created and used for educational purposes. The climbing wall assembly may include adjoining wall panels with markable surfaces and/or molded wall panels having a surface with metallic or magnetic properties for use with magnetic or metallic, educational elements. The climbing wall assembly further comprises the use of wall plates and hand holds which are preferably molded of a plastic composition which incorporate embedded metallic particles for use with magnetic educational elements. The educational climbing wall assembly of the invention comprises wall panels, wall plates and hand holds are constructed and arranged to provide a climbing wall assembly that permits climbing routes to be created and changed and which permit magnetic pieces to be placed and moved on the wall assembly elements for recreational and educational purposes.

The wall panels of the invention include molded structures which have means to receive wall plates and hand holds at a plurality of predetermined positions. Alternative wall panel structures are also disclosed. Further, the wall panels have surfaces which may receive chalk markings, magnetic pieces and adhesive structures, such as stickers, tape, laminates, dry erase marker or write-on and wash off marker. Further provided by this invention are methods of manufacturing the wall panels, wall plates and hand hold structures of the invention.

The wall or route plates used in the climbing wall assembly of the invention are designed for use in educational climbing wall activities. The wall or route plates may be mounted between the climbing wall and the climbing hand hold and/or mounted separately to the climbing walls. For example, 30-50 route plates may be used on a 40-foot traverse climbing wall and provides a number of climbing routes, i.e., beginner, intermediate and advanced.

The routes may be identified by colors, geometric shapes and markings to provide young climbers with the ability to improvise various climbing games using colors, numbers, letters, words, shapes, animal figures, maps, pictures and symbols, i.e. mathematical symbols.

The wall plates may also be provided with apertures for inset discs which are preferably brightly colored and are easily visible to climbers. The different colored discs are utilized to differentiate varying climbing routes. For example, hand holds that are marked with green discs may provide a beginner climbing route and holds that are marked with red discs may provide an advanced climbing route. Alternatively, the colors may be used to signify or identify a particular climber that created the route. Route setting and resetting is an integral part of utilizing the climbing wall assembly of the invention for educational and recreational purposes.

Another application for the route wall plates may involve using lettered and numbered discs. For example, a complete alphabet set (A-Z), numbers 0-9, words and symbols, i.e. mathematical, musical, geometrical, geographical and scientific symbols, may be utilized in the present invention. Use of the numerical and letter discs facilitates spelling and number games on the climbing wall and eliminates the difficulty and inconvenience of creating and using paper letters and numbers tucked under the hand holds. The letters and numbers on the discs are preferably raised and textured and mounted on a geometrically shaped body, such as a rigid urethane, flexible rubber or other body structures, so that the discs may be easily inserted and removed by the climber. The discs may be molded in a one piece structure (body and letter or number) such as of a molded urethane structure or the like, for example.

These and other benefits of this invention will become clear from the following description by reference to the drawings.

DESCRIPTION OF THE PREFERRED EMBODIMENTS

The magnetic climbing wall assembly of the invention comprises a plurality of wall panels, wall plates, hand holds and educational elements that permit numerous climbing routes to be created and used for educational purposes. The climbing wall assembly includes adjoining molded wall panels having exterior surfaces adapted to receive erasable markings and/or having metallic or magnetic properties for use with magnetic or metallic, educational elements. The climbing wall assembly further comprises the use of wall plates and hand holds which may be molded of a plastic composition which incorporate embedded metallic or magnetic particles for use with magnetic or metallic educational elements. In summary, the educational climbing wall assembly of the invention comprises wall panels, wall plates and hand holds that may be constructed and arranged to provide a climbing wall assembly having the ability of numerous climbing routes to be created and that permits magnetic or metallic pieces, stickers, laminates, chalk, markers and the like to be placed and moved for recreational and educational purposes.

Figure 1:
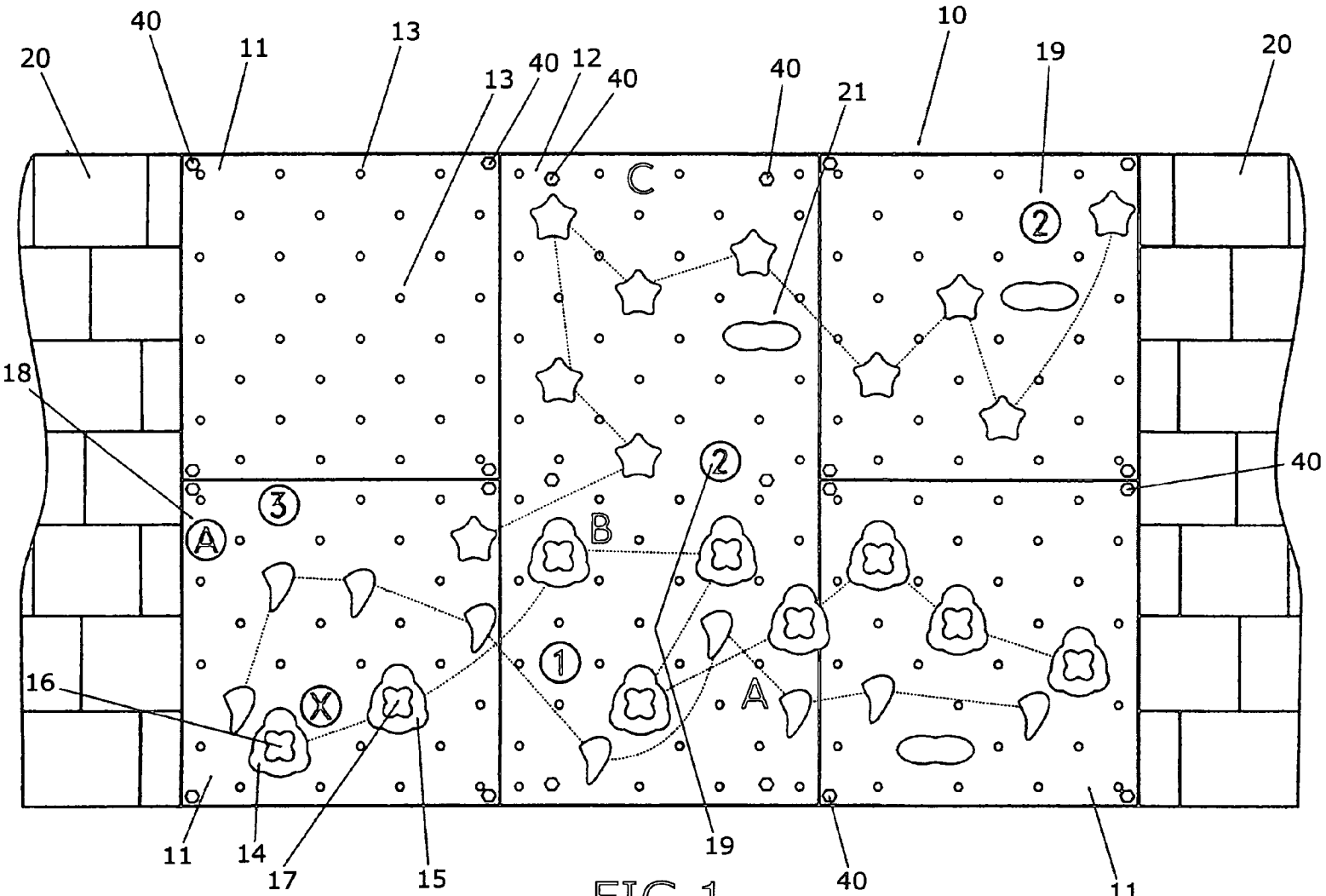
FIG. 1 is a plan view showing the climbing wall assembly of the present invention mounted to a structural wall of a building.

Referring to FIG. 1, a climbing wall assembly 10 of the present invention is shown mounted to structural wall 20. For example, the climbing wall assembly 10 may be mounted by means of bolts 40 to a concrete block or other wall structure in a school gymnasium for example. The structural wall may be provided with wooden members attached to a concrete or like wall, for example, and to which the climbing wall assembly 10 is mounted. Alternatively, the wall assembly 10 may be mounted to a free standing structural member.

Figure 2:
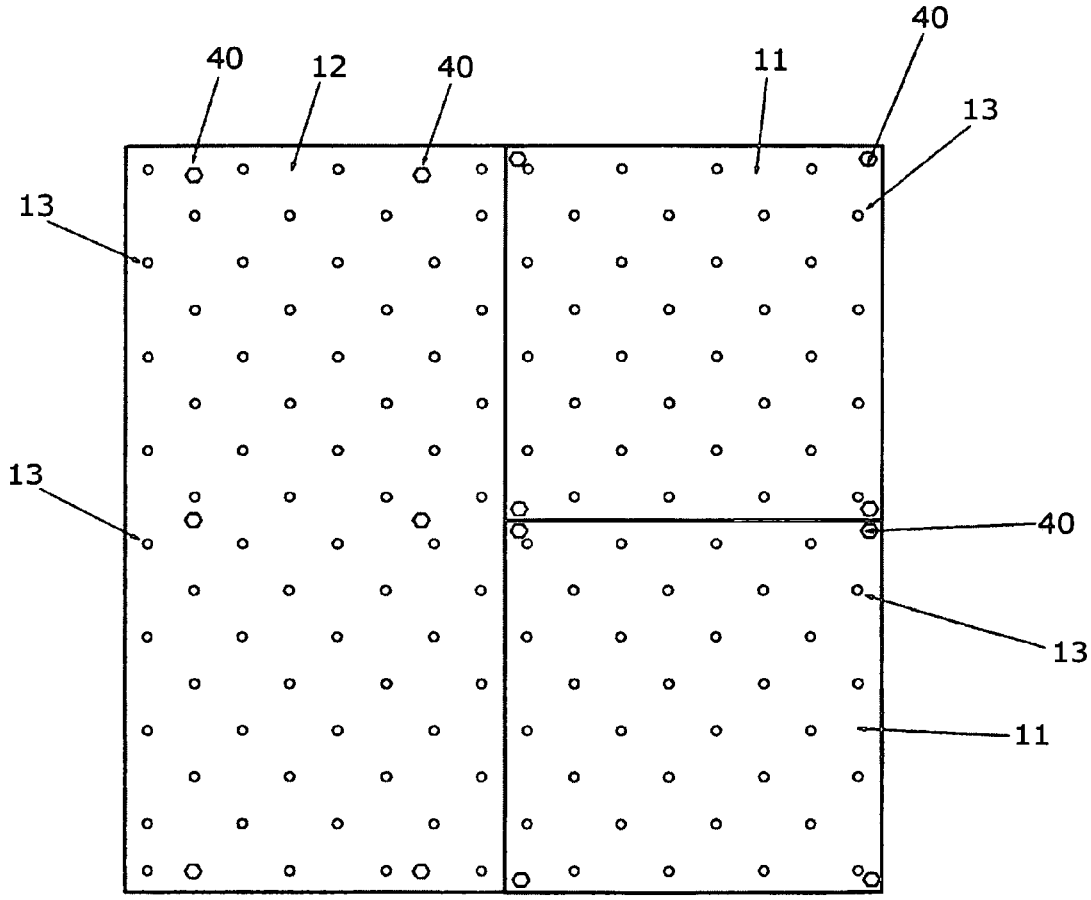
FIG. 2 is a plan view showing adjoining wall panel structures of the present invention.

Referring to FIGS. 1 and 2, the climbing wall assembly 10 is shown comprised of a plurality of adjoining individual wall panels 11 and 12. For example, the wall panels 11 may be 4 ft.×4 ft. sized panels and panels 12 may be 4 ft.×8 ft. sized panels. These rectangular wall panel areas are exemplary of wall panels that may be joined adjacently to form a climbing wall. The individual panels 11 and 12 are shown mounted in a side by side arrangement and may be of any height and length to accommodate a particular building wall area or to provide a climbing wall having a particular area, i.e., 40 ft. long and 8 ft. high.

Each wall panel 11 and 12 is shown to have a plurality of apertures 13 which are shown in a predetermined pattern covering the entire area of an individual panel. These apertures 13 have means to connect the wall plate structures 14 and 15 and hand holds 16 and 17 to the individual wall panels. The pattern of apertures 13, thereby permit the wall plates and hand holds to be mounted to wall panels in any desired pattern to thereby permit a multiplicity of climbing routes to be created. Wall panel 12 is shown having a plurality of spaced apertures 13 which are arranged in a pattern and positioned and adapted to receive the wall plates and hand hold structures. Each aperture 13 preferably has means, such as a T-nut structure mounted therein or having other fastening means, for fixing the wall plates and/or hand hold structures thereto. Further, fastening bolts 40 are shown for securing the wall panel 12 through wall panel mounting apertures to a building wall structure, if desired. The wall panels may be otherwise secured to a wall by known means or alternatively mounted to a free standing frame structure.

Figure 3:
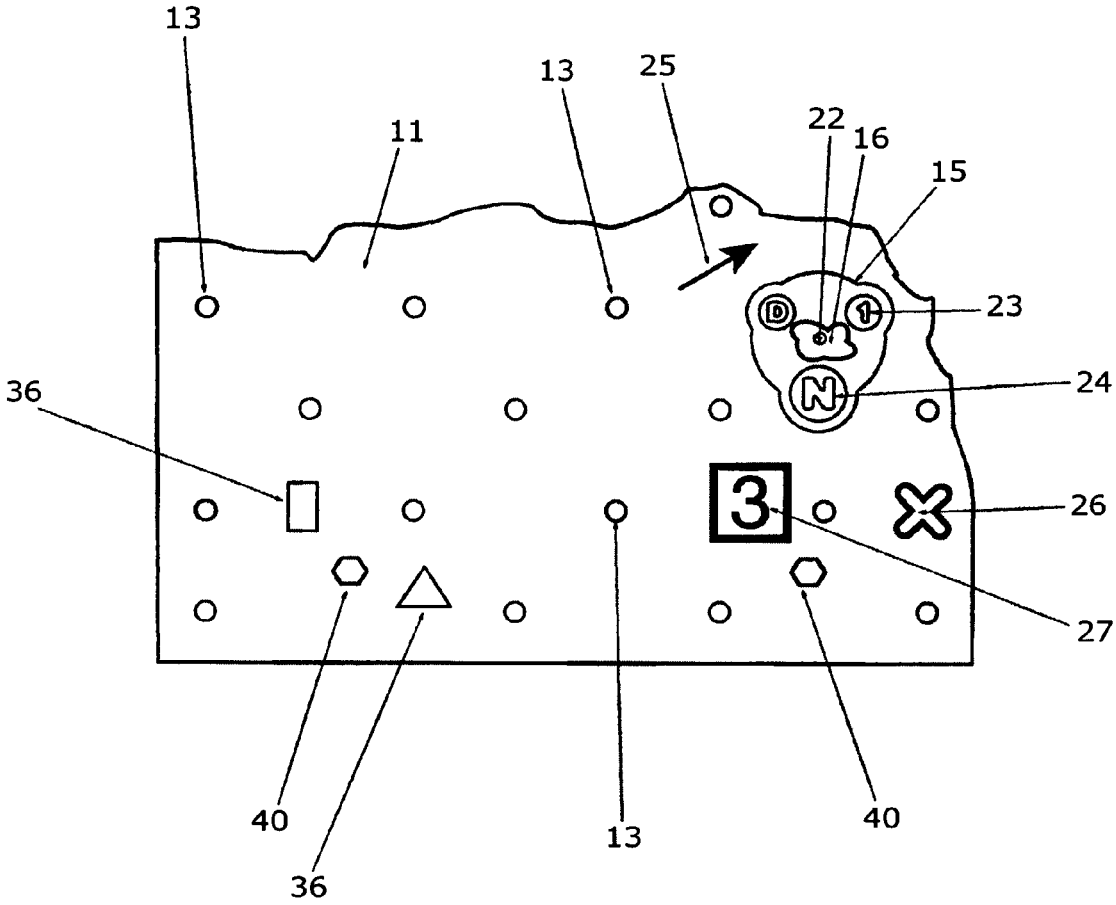
FIG. 3 is a plan view showing a wall panel, a plate structure, hand hold and educational elements of the invention.

Referring to FIGS. 1 and 3, an individual wall panel 11 may have a number of educational elements which are movably attached to either the surface of the wall panel 11 or to the components mounted to the wall panel 11, i.e., wall plate 15 and hand hold 16. For example, as shown, magnetic geometric shapes 36, magnetic letters 18, 26 and magnetic numerals 19, 27 may be attached to the surface of wall panel 11. Further, as shown, wall plate structure 15 may have removable letter insert 24 therein. The hand hold 16 and wall plate 15 structures are shown mounted to the wall panel 11. Individual hand hold structures 21 are also shown mounted to wall panel 12.

Figure 4:
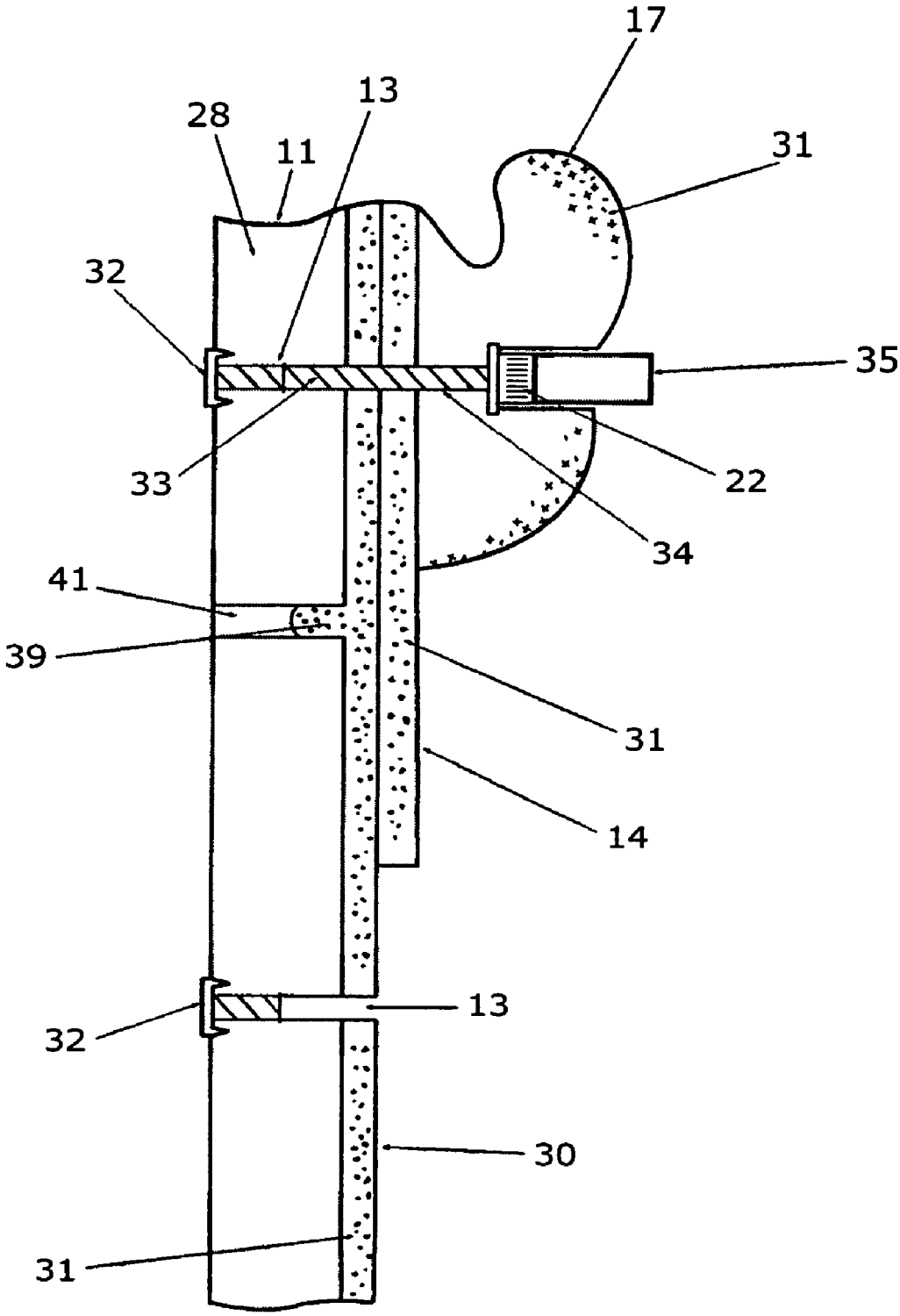
FIG. 4 is a sectional view of a wall panel of the present invention.

FIG. 4 is a sectional view showing the wall panel 11 and the wall plate structure 14 and hand hold 17 mounted to the wall panel 11. The wall panel 11 is shown comprised of a base structure 28, i.e., a sheet of plywood (¾ inch thickness, for example) and an outer layer 30 molded to the base structure 28. The outer layer 30 is preferably of a urethane or similar plastic composition, for example. The surface of the plastic layer 30 may also be constructed to receive markings 25, for example, as shown in FIG. 3, to thereby allow a climber to physically mark a route. The molded wall panel 11 is further shown having a plurality of T-nuts 32 attached to the back of the base structure 28 and positioned in apertures 13. T-nuts 32 are metallic structures having internal threads for receiving bolts 33 having bolt heads 22. The bolts 33 are shown to attach the hand holds 17 and wall plates to the wall panel 11. As further shown, a magnetic rod elements 35 may be used on bolt head 22 of bolt 33 and to extend from the hand hold 17 for marking use by climbers.

Figure 8:
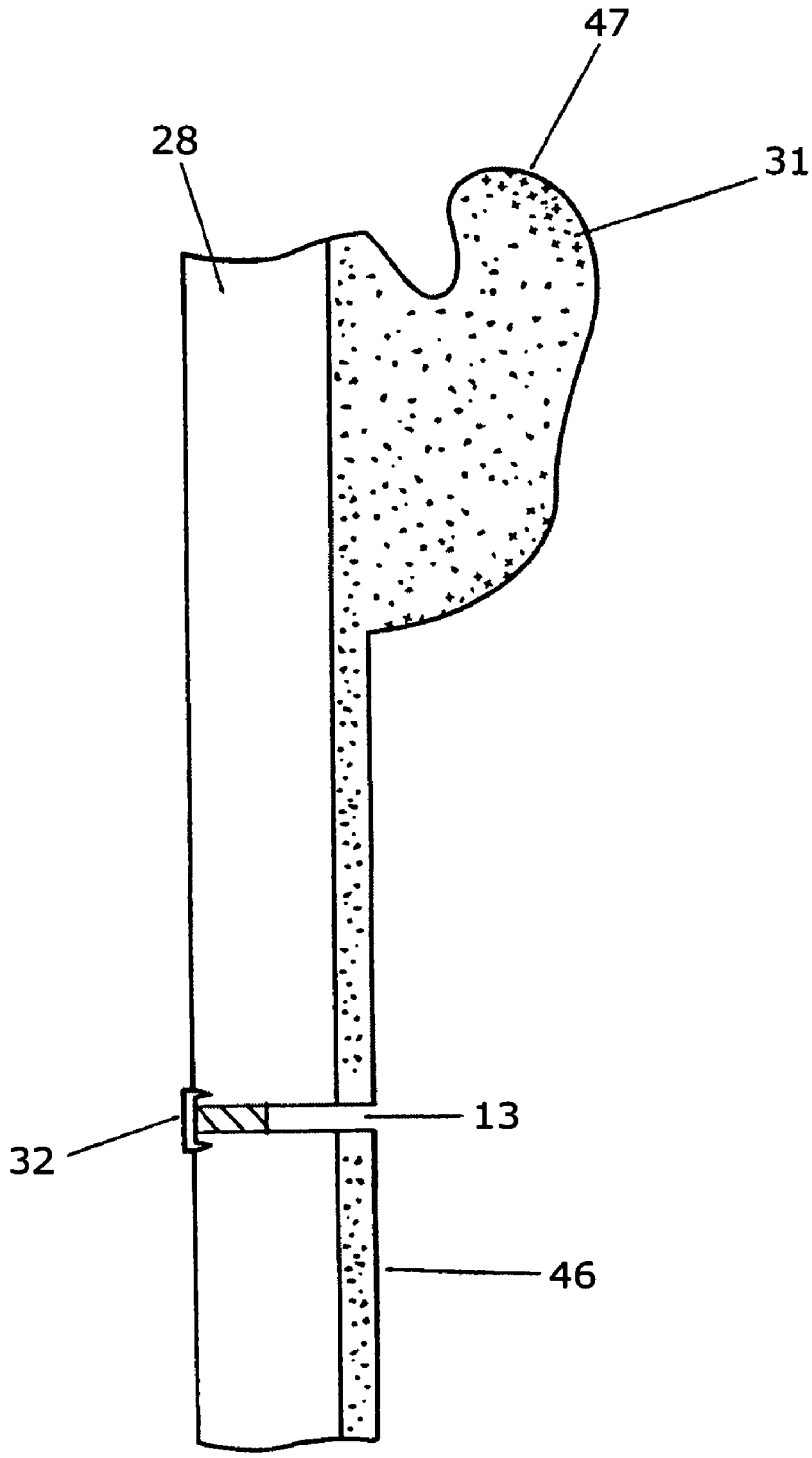
FIG. 8 is a sectional view showing another wall panel embodiment.

One embodiment of the wall panels 11 and 12 are preferably molded in an operation that generally comprises mixing a two part urethane resin, for example, and pouring the liquid resin in a mold, such as a silicone mold. Next, a base member 28, for example, a sheet of ¾ inch plywood, MDF (medium density fiberboard), a sheet of plastic, a sheet of metal, a sheet of composite wood/plastic or a combination thereof is placed on top of the urethane mixture in the mold. Upon curing of the urethane mixture, the wall panel is formed. In molding the wall panels 11 and 12 the bottom surface of the mold preferably has spaced protrusions extending therefrom to form apertures or holes in the outside surface of the urethane layer 30 and which are subsequently used to drill through the base structure 28 to form the apertures 13 in the wall panels 11 and 12. Alternatively, the wall panel may be formed of a one piece molded plastic structure. This process or other molding processes may also be utilized to provide wall panels having molded handhold structures unitary with the panels, as shown in FIG. 8.

Figure 5:
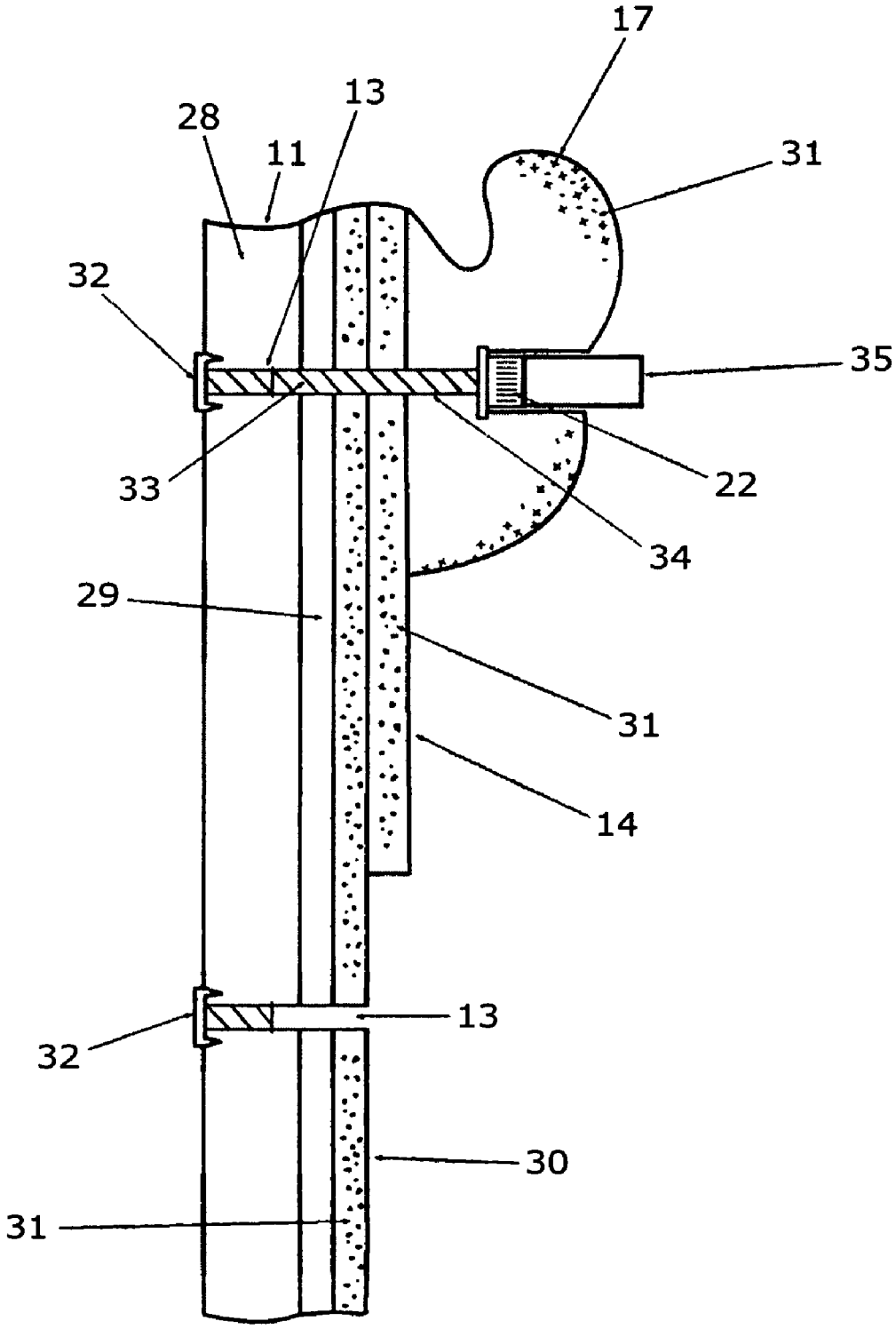
FIG. 5 is a sectional view showing another wall panel embodiment.

As shown in FIG. 5, the base structure 28 may also be laminated to the molded urethane panels by means of a layer 29 of urethane resin. Alternatively, an adhesive or mechanical means may be used to secure the urethane panel to the base structure 28. As will be further discussed, other panels, such as writing boards may be secured to the base structure 28 to form a wall panel.

In the above referenced molding process, the base structure 28, i.e., plywood panel, is initially provided with a plurality of apertures 41 to provide air holes (i.e. randomly or uniformly spaced apertures in the base structure) to thereby provide the nubs 39 in the molded urethane 30 and which protrude into the air holes 41 and also to aid in securing the urethane panel and base member together, as shown in FIG. 4. The mold used in the manufacture of the wall panels, wall plates and hand holds are preferably constructed of a silicone structure or the like. The mold may further have a smooth or rough surface, may be flat or planar or may have a profile to assimilate a rock form. The wall plates and hand hold structures are also formed in a mold of a urethane resin, however, the wall plate and hand hold members do not utilize a base member, i.e., plywood, and instead are comprised of a molded urethane structure, or like molded plastic.

The urethane resin preferably has metallic particles, such as pellets or the like, mixed therein so that the molded panel, plates and hand holds will have metallic properties. In addition or alternatively, the metallic elements may be dropped into the resin after the resin has been poured into the mold.

Although the wall panels of the invention and the process of manufacturing the wall panel, hand holds and wall plates are described as having metallic particles placed therein for subsequent use with magnetic elements, magnetic walls, hand holds and plates may be used instead and the educational pieces may have metallic or magnetic elements incorporated therein for use with the magnetized panels, plates and hand hold elements. Regarding the magnetic elements used in the invention, preferably earth magnets are utilized for their magnetic strength.

Referring further to FIG. 4, the outer urethane layer 30, the plate structure 14 and the inner surface of the hand hold 17 are shown to have metallic particles 31 embedded therein so that magnetic pieces may be held thereto according to the teachings of the present invention.

The wall panel exterior surfaces of the present invention are constructed and arranged to have educational writing board capabilities. The surfaces include chalkboard and "white board" surfaces, either with metallic and/or magnetic qualities to thereby provide marking capability as well as providing the use of magnetic and/or metallic educational elements.

The markers that may be utilized with the writing board surfaces may include dry erase, write-on/wash-off type markers, crayons, pens, pencils, removable paint and like markers. The latter marking devices are utilized by and familiar to students and such and like writing utensils are preferred for use with this invention. Further, stickers may also be utilized such as those having adhesive release qualities.

Although writing boards having hard glossy surfaces, such as a plastic, melamine or porcelain composition are often referred to as "white boards", such surfaces may be provided in any desired color. Likewise, chalkboards having smooth surfaces usually made of slate, glass or wood compositions for crayons or chalk are often referred to as "black boards", may also be provided in any desired color. These writing board surfaces although normally flat, may also be contoured and may include formed handhold structures. Further, these writing surfaces may be placed onto a base structure via lamination, paint spray, or the like and may include an underlying layer of a metallic or magnetic composition whereby both writing and magnetic and/or metallic educational elements may be utilized by the climbers.

Figure 6:
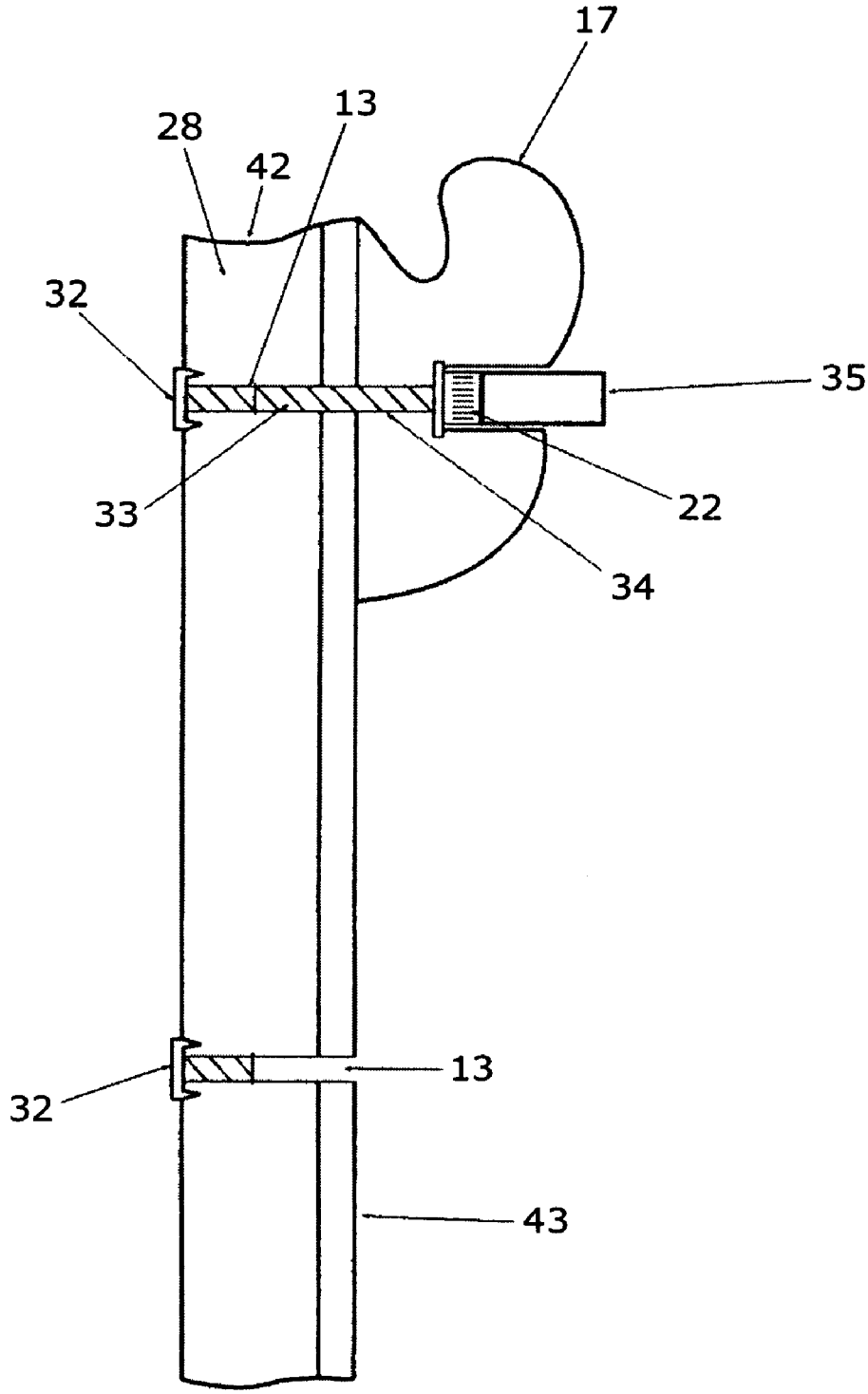
FIG. 6 is a sectional view showing an alternative wall panel embodiment.

FIG. 6 is a sectional view showing wall panel 42 having base structure 28 having a "chalkboard" surface 43 affixed thereto. The surface 43 may be fixed by means of adhesive or other fastening means to the base structure 28, i.e., a sheet of plywood or other base structure. Apertures 13 having T-nuts 32, or other fastening means, are similarly shown having hand hold 17 mounted to the wall panel 42.

Figure 7:
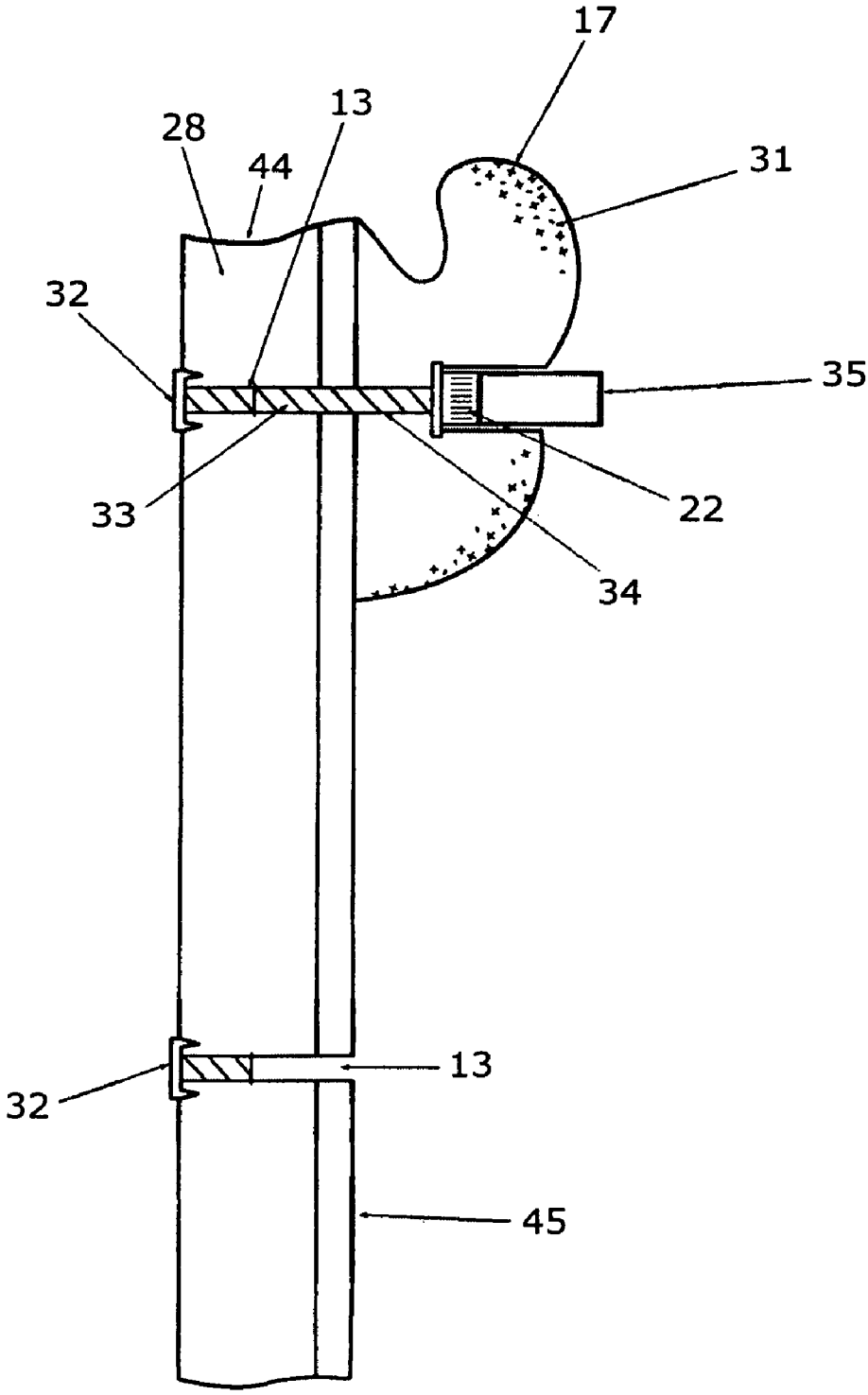
FIG. 7 is a sectional view showing another wall panel embodiment.

FIG. 7 is a sectional view having wall panel 44 having a base structure 28 having a "white board" surface 45 affixed thereto. The white board surface 45 is a hard impermeable plastic material adapted to receive markings, i.e., from erasable markers utilized in classrooms, for example.

The climbing wall assemblies of the invention may include adjoining wall panels having like exterior surfaces or adjoining wall panels having different exterior surfaces. The latter wall panel different surface arrangement, whether different in color, different in marking ability, or having different properties, i.e. magnetic, non-magnetic, can be utilized for educational purposes; for example, identification of the different surfaces by the climbers via the use of the appropriate corresponding educational elements by placement on specific wall surfaces.

FIG. 8 is a sectional view showing base structure 28 having molded layer 46 attached thereto. Importantly, hand hold structure 47 is shown unitarily molded with layer 46. Alternatively, base structure 28 may be eliminated by increasing the thickness of molded layer 46 to thereby provide a structural element. Further, metallic particles 31 are shown in layer 46. As discussed, magnetic particles may also be utilized in layer 46 or a metallic or magnetic layer may be disposed between base structure 28 and molded layer 46 to yield metallic or magnetic properties for use with corresponding educational elements. T-nut 32 is shown positioned in aperture 13 whereby wall plates, for example, may be mounted to the structure.

Figure 9:
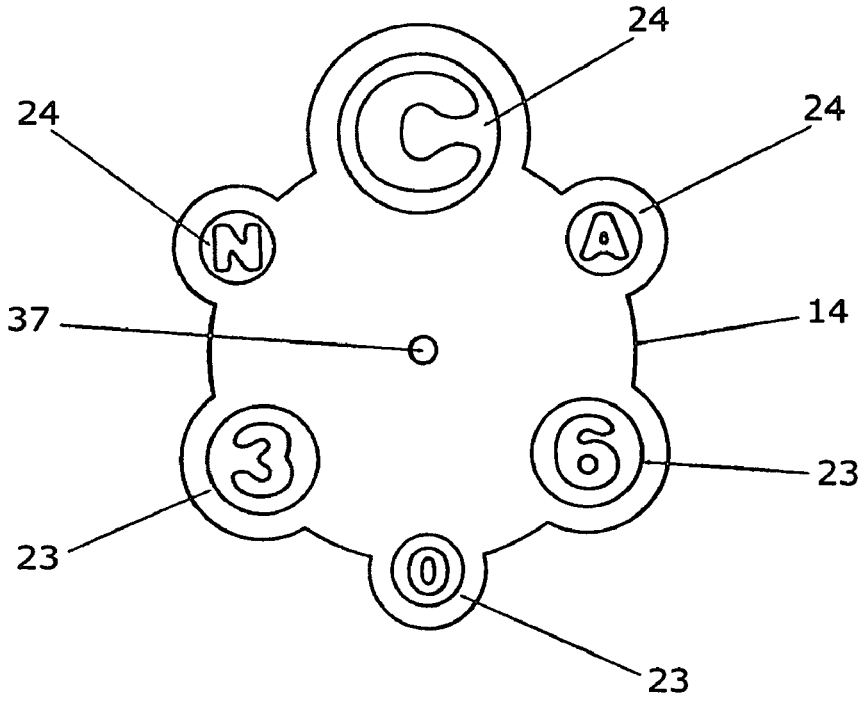
FIG. 9 is a plan view showing a plate structure used in the climbing wall assembly of the invention.
Figure 10:
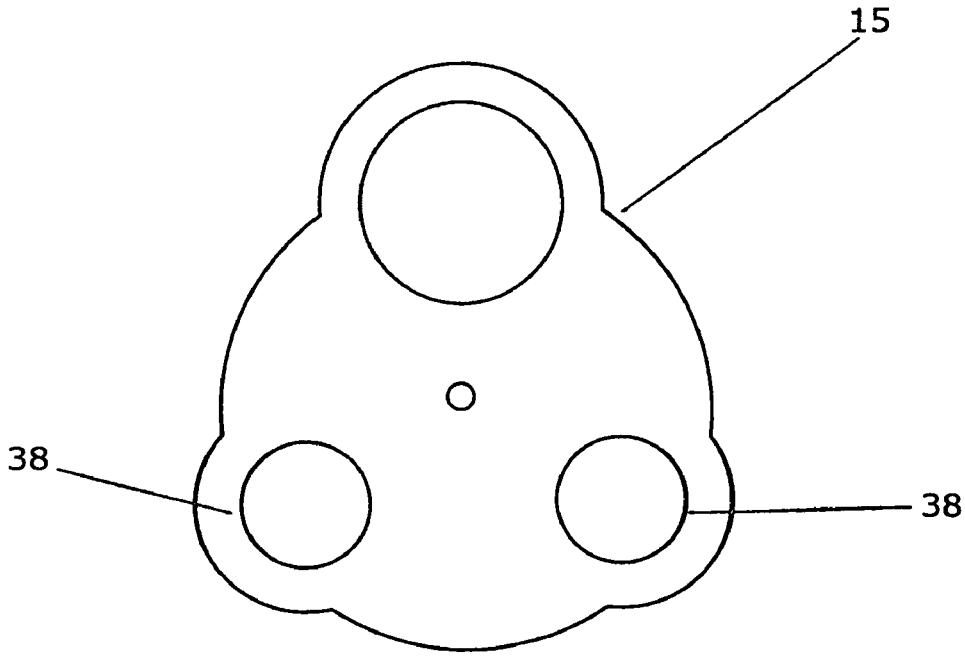
FIG. 10 is a plan view showing another plate structure used in the climbing wall assembly of the invention.
Figure 11:
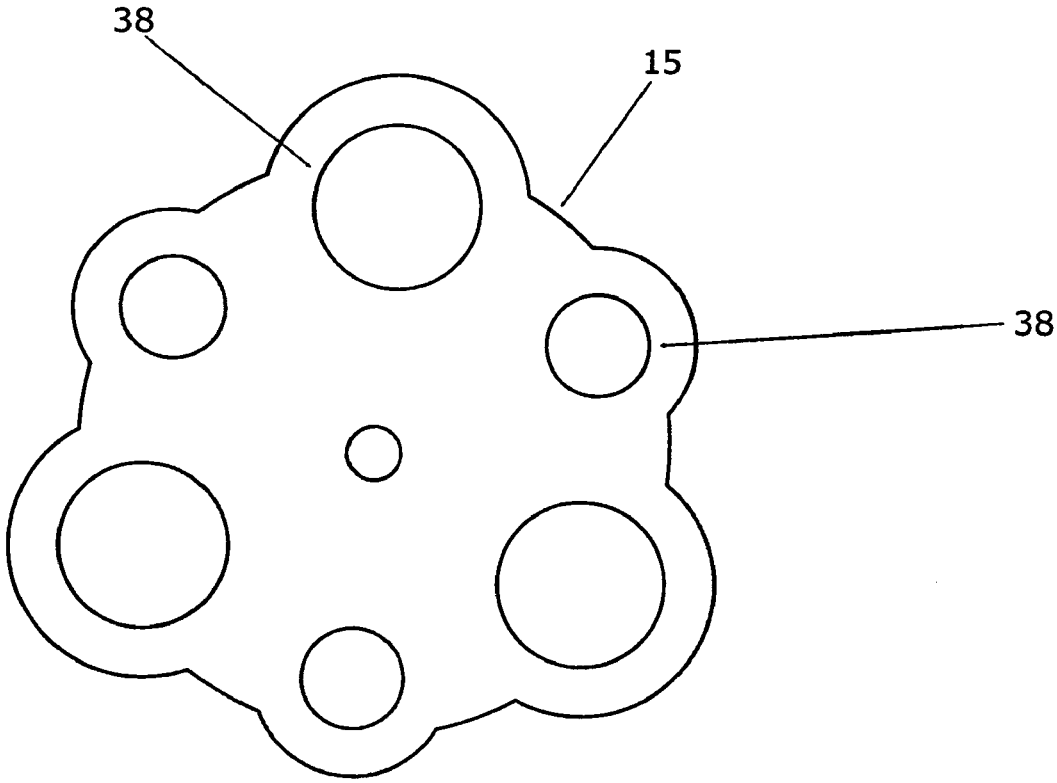
FIG. 11 is a plan view showing another plate structure used in the climbing wall assembly of the invention.

FIG. 9 is a plan view showing a wall plate structure 14 having a geometric shape having an aperture 37 for mounting the wall plate 14 to a wall panel 11, for example, and having a plurality of removable numerical inserts 23 and a plurality of removable letter inserts 24 which are placed in circular apertures in the periphery of the wall plate structure 14. Further, FIGS. 10 and 11 show other geometrically shaped wall plates 15 having peripheral apertures 38 for receiving the numerical and letter inserts.

The route plates 14, 15 used in the climbing wall assembly 10 of the invention are designed for use in educational climbing wall activities. The wall or route plates 14, 15 may be mounted between the climbing wall panel 11 and the climbing hand hold 16. The route plates 14, 15 are affixed to the wall panel 11 in a similar manner as a hand hold, for example, with a ⅜, 16 thread socket head cap screw, i.e., bolt 33. Each bolt or screw 33 passes through an enlarged aperture 34 of a hand hold structure 17. This dimension may be larger than a standard hole or may be slotted to enable the wall plate 14, 15 to be adjusted so that the hand hold 17 does not cover any of the discs 23, 24, six for example, and so that each plate 14 can be separated from nearby plates, i.e., 15. For example, 30-50 route plates 14, 15 may be used on a 40-foot traverse climbing wall.

The wall plate structures of the present invention may also be utilized on any other climbing wall structure. For example, the wall plate structures and associated educational elements, whether metallic, magnetic or frictional fit may be mounted via any fastening means, i.e., mechanical, adhesive, etc., to known wall climbing structures to provide educational aspects and uses by young climbers, for example.

After attachment to the wall panels 11, the wall plates 14 and the inset discs 24, which are preferably brightly colored, are easily visible to climbers. The different colored discs 24 may be utilized to differentiate varying climbing routes, i.e., A, B, C or to designate the difficulty of the route. For example, hand holds "marked" with green discs may show a beginner climbing route, i.e., route A, and holds "marked" with red discs may show an advanced climbing route, i.e., route C. Alternatively, the colors may be used to signify a particular climber that created the route. Route setting and resetting is an integral part of utilizing the climbing wall assembly 10 of the invention for educational and recreational purposes.

Another application for the route wall plates involves using lettered discs 24 and numbered discs 23. For example, a complete alphabet set (A-Z) and the numbers 0-9 may be utilized in the present invention. Use of the numerical discs 23 and letter discs 24 facilitates spelling and number games on the climbing wall and eliminates the difficulty and inconvenience of creating and using paper letters and numbers tucked under the hand holds. The letters and numbers on the discs 23, 24 are preferably raised and textured and mounted on a body having a predetermined size and shape, so the discs are easily inserted and removed by the climber.

The wall route plates 14, 15 may be approximately 0.25" thick and approximately 8 inches wide and 10 inches long. Each route plate 14, 15 may have six removable discs (i.e., 23, 24), for example, set inside and along the outer edges of the plastic plate structure 14 as shown in FIG. 9. The diameters of the discs may be as follows: one at 3", two at 2" and three at 1.25". The discs 23, 24 may have six different colors, for example. Smaller versions and other shapes of the wall route plate may also be utilized.

As many changes are possible to the embodiments of the assemblies of this invention utilizing the teachings thereof, the descriptions above, and the accompanying drawing should be interpreted in the illustrative and not in the limited sense.

That which is claimed is:

1. A climbing wall assembly having a wall plate member comprising:

a) a climbing wall having an exterior surface and at least one mounting element integral the climbing wall;

b) at least one hand hold structure having an aperture therethrough to receive fastening means which cooperate with said integral mounting element to secure said handhold to said climbing wall;

c) said wall plate member having a plate body having at least one aperture therethrough to receive fastening means which cooperate with said integral mounting element for mounting said plate body against said climbing wall exterior surface, said exterior surface of said wall plate member being a whiteboard surface or a chalk board surface, said wall plate member further having metallic or magnetic properties for receiving magnetic or metallic educational elements; and d) educational elements each have formed bodies and being selected from the group of elements consisting of colors, number, letters, shapes, words, figures, pictures and symbols.

2. The wall plate member of claim 1, wherein said climbing wall has a plurality of apertures therethrough for providing means to create a plurality of climbing paths and wherein a plurality of wall plate members are provided in a specified arrangement on said climbing wall to designate a climbing route.

3. The wall plate member of claim 2, wherein said wall plate members of said climbing wall have distinct colors to designate climbing route difficulty.

4. The climbing wall assembly of claim 1, wherein said integral mounting element of said climbing wall is a T-nut structure and wherein said wall-plate member is positioned between said climbing wall exterior surface and said hand hold structure.

5. The wall plate member of claim 1, wherein said wall plate body has at least one second aperture adapted for receiving an educational element and wherein said educational elements comprise insert discs having shaped bodies for the removable mounting in said second apertures.

6. A climbing wall assembly having a wall plate member comprising a climbing wall having at least one mounting aperture therein having a fastening element embedded therein and integral the wall, a wall plate member comprising a generally planar wall plate body having at least one bore therethrough to receive a fastener extending through said at least one bore and in cooperation with said embedded fastening element to attach said wall plate body to a wall surface of the climbing wall, said wall plate body being adapted for educational purposes, said wall plate body having an exterior surface adapted to receive erasable markings, educational elements provided for use with said wall plate member, said wall plate body having at least one second aperture adapted for receiving an educational element and said educational elements comprising insert discs having shaped bodies for the removable mounting in said second apertures.

7. The climbing wall assembly of claim 6, wherein said educational elements have bodies formed in the shape of numbers letters, words and geometric shapes.

8. The climbing wall assembly of claim 6, wherein said wall plate member has means to receive cooperating magnetic or metallic educational elements and wherein said means for receiving educational elements is metallic or magnetic particles embedded within said wall plate member.

9. The climbing wall assembly of claim 7, wherein said educational elements are selected from the group of elements consisting of colors, numbers, letters, shapes, words, figures, pictures and symbols.

10. The climbing wall assembly of claim 6, wherein said wall plate member is disposed between the wall surface and a hand hold structure of a climbing wall.

11. The climbing wall assembly of claim 6, wherein a plurality of wall plate members are provided for arrangement on a climbing wall to designate a specified climbing route and wherein said wall plate members of said climbing wall are colored to designate climbing route difficulty.

12. The climbing wall assembly of claim 6, wherein said wall plate body is constructed of a molded polymeric material.

13. The climbing wall assembly wall plate member of claim 7, wherein said wall plate body further has at least one aperture for frictionally receiving said educational elements.

14. The climbing wall assembly of claim 13, wherein said educational elements comprise insert discs having shaped bodies for the removable frictional mounting in said apertures.

15. A climbing wall assembly having a wall plate member comprising:

a) a climbing wall having an exterior surface and at least one mounting element integral the climbing wall;

b) at least one hand hold structure having an aperture therethrough to receive fastening means which cooperate with said integral mounting element to secure said handhold to said climbing wall;

c) said wall plate member having a plate body having at least one aperture therethrough to receive fastening means which cooperate with said integral mounting element for mounting said plate body against said climbing wall exterior surface, said wall plate member having metallic or magnetic properties for receiving magnetic or metallic educational elements; and d) said wall plate body having at least one second aperture adapted for receiving an educational element, said educational elements comprising insert discs having shaped bodies for the removable mounting in said second apertures of said wall plate body.

16. The climbing wall assembly of claim 15, wherein said educational elements are further attachable to said wall plate body via an adhesive.

17. The climbing wall assembly of claim 15, wherein said wall plate body has an exterior surface adapted to receive erasable markings.

* * * * *